US005104758A

United States Patent [19]

Mashimo et al.

[11] Patent Number: 5,104,758

[45] Date of Patent: Apr. 14, 1992

[54] ELECTROPHOTOGRAPHIC PHOTORECEPTOR COMPRISING A SQUARYLIUM COMPOUND AND SELENIUM OR A SELENIUM ALLOY

[75] Inventors: Kiyokazu Mashimo; Ryosaku Igarashi; Ichiro Takegawa; Yasuo Sakaguchi; Shigetoshi Nakamura; Kohichi Yamamoto, all of Kanagawa, Japan

[73] Assignee: Fuji Xerox Co, Ltd., Tokyo, Japan

[21] Appl. No.: 521,713

[22] Filed: May 11, 1990

[30] Foreign Application Priority Data

May 16, 1989 [JP] Japan ..... 1-120485

[51] Int. Cl.[5] ..... G03G 5/06

[52] U.S. Cl. ..... 430/73; 430/74; 430/95

[58] Field of Search ..... 430/58, 59, 73, 74, 430/95

[56] References Cited

U.S. PATENT DOCUMENTS 4,707,427 11/1987 Tanaka et al. ..... 430/73

4,948,687 8/1990 Murase et al. ..... 430/73

FOREIGN PATENT DOCUMENTS 59-32788 6/1985 Japan .

*Primary Examiner*—John Goodrow

*Attorney, Agent, or Firm*—Finnegan, Henderson, Farabow, Garrett and Dunner

[57] ABSTRACT

An electrophotographic photoreceptor comprising an electrically conductive substrate having thereon a photosensitive layer is disclosed, wherein the photosensitive layer contains, as a charge generating material, a dispersion of selenium or a selenium alloy and at least one squarylium compound represented by formula (I):

(I)

wherein A represents a fluorine atom, a hydrogen atom or a hydroxyl group, with B representing a hydroxyl group; or A represents a hydrogen atom or a fluorine atom, with B representing a methyl group, in the same binder resin. The electrophotographic photoreceptor not only has broad spectral sensitivity from the visible to infrared region but is excellent in other electrophotographic properties.

6 Claims, 3 Drawing Sheets

ELECTROPHOTOGRAPHIC PHOTORECEPTOR COMPRISING A SQUARYLIUM COMPOUND AND SELENIUM OR A SELENIUM ALLOY

FIELD OF THE INVENTION

This invention relates to an electrophotographic photoreceptor, and more particularly to an electrophotographic photoreceptor comprising an electrically conductive substrate having laminated thereon a charge generating layer and a charge transporting layer.

BACKGROUND OF THE INVENTION

Function separated type electrophotographic photoreceptors having a charge generating layer and a charge transporting layer have hitherto been proposed. Electrophotographic photoreceptors of this type have recently been used in not only electrophotographic copying machines but in printers using a semiconductor laser, a light-emitting diode, etc. as a light source. Accordingly, there has been a strong demand for a charge generating material having broad spectral characteristics of from the visible region to the infrared region (i.e., 400 to 800 nm).

None of the so-far proposed charge generating material has such broad spectral characteristics when used alone. Therefore, JP-B-59-32788 (the term "JP-B" as used herein means an "examined published Japanese patent application") suggests an electrophotographic photoreceptor having a charge generating layer containing at least two pigment dyestuffs different in spectral sensitivity (the pigment dyestuff whose spectral sensitivity is in the longer wavelength region is a phthalocyanine pigment).

However, when compared with conventional systems containing a single pigment, the above-described electrophotographic photoreceptor undergoes serious local reduction in sensitivity as shown in FIGS. 2 and 3. In FIG. 2, D, E, and F indicate spectral sensitivity of a perylene pigment, a phthalocyanine pigment, and a mixture thereof, respectively. In FIG. 3, G, H, and I indicate spectral sensitivity of a flavanthrone pigment, phthalocyanine pigment, and a mixture thereof, respectively. Further, a pigment dyestuff to be used in the longer wavelength region (i.e., infrared region), when used alone, generally exhibits poor electrophotographic characteristics, such as electrification properties, dark decay properties, and stability to environment and/or repeated use. If it is used as a mixture with a pigment to be used in the shorter wavelength region (i.e., visible region), it adversely affects the characteristics of the latter. As a result, the mixed pigment system also suffers from deterioration in the above-mentioned electrophotographic characteristics (electrification properties, dark decay properties, and stability to environment and/or repeated use) as compared with a single pigment system.

SUMMARY OF THE INVENTION

An object of this invention is to provide an electrophotographic photoreceptor having spectral sensitivity in a broadened range of from visible to infrared regions and also other excellent electrophotographic characteristics.

In order to eliminate the problems associated with the conventional electrophotographic photoreceptors, the inventors have conducted extensive investigations and, as a result, have found that a combined use of a squarylium compound represented by formula (I) shown below, which has, when used alone, a high dark decay rate and insufficient stability to environment and/or repeated use, with selenium or a selenium alloy brings about remarkable improvement in these characteristics, and particularly stability to environment and/or repeated use. The present invention has been completed based on this finding.

The above object of this invention is thus accomplished by dispersing selenium or a selenium alloy and at least one squarylium compound represented by formula (I) in the same binder resin to obtain a charge generating material of a photosensitive layer.

That is, the present invention relates to an electrophotographic photoreceptor comprising an electrically conductive substrate having thereon a photosensitive layer, wherein the photosensitive layer contains, as a charge generating material, a dispersion of selenium or a selenium alloy and at least one squarylium compound represented by formula (I):

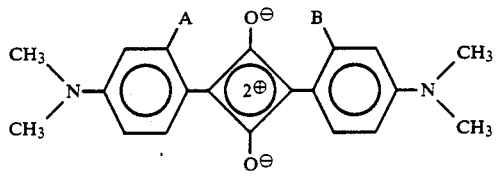

(I)

wherein A represents a fluorine atom, a hydrogen atom or a hydroxyl group, with B representing a hydroxyl group; or A represents a hydrogen atom or a fluorine atom, with B representing a methyl group, in the same binder resin.

DETAILED DESCRIPTION OF THE INVENTION

The photosensitive layer formed on an electrically conductive substrate may have a single-layered structure containing a charge generating material and a charge transporting material, and preferably has a laminated structure in which a charge generating layer and a charge transporting layer are successively laminated.

Figure 4:
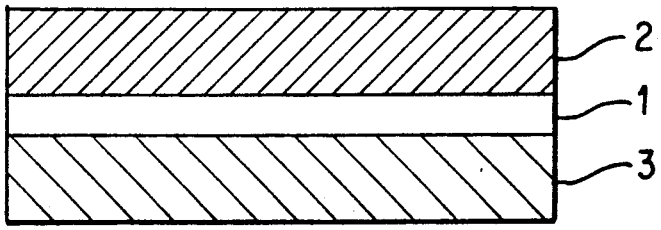
FIGS. 4 through 7 each illustrates a schematic cross-section of the electrophotographic photoreceptor according to the present invention.
Figure 5:
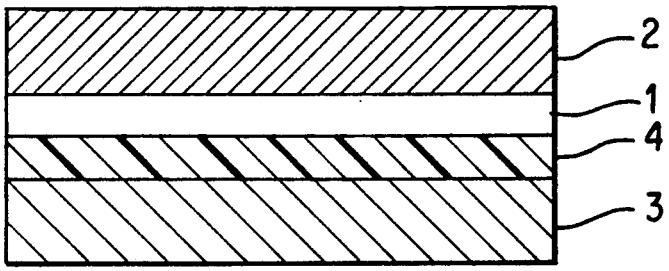
Figure 6:
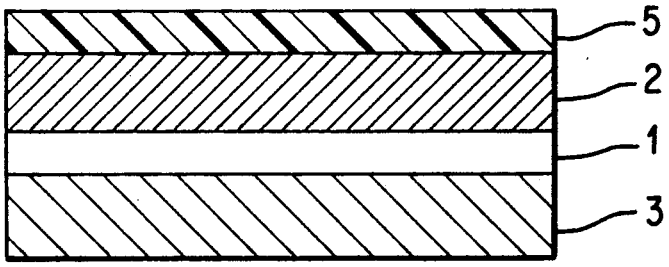
Figure 7:
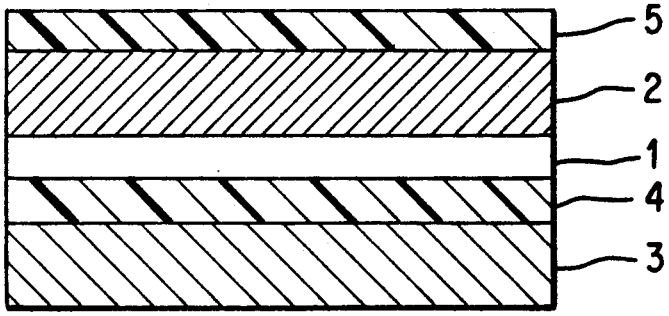

FIGS. 4 through 7 each illustrates a schematic cross-sectional view of the electrophotographic photoreceptor according to the present invention in which the photosensitive layer has a laminated structure. In FIG. 4, charge generating layer 1 and charge transporting layer 2 are provided on electrically conductive substrate 3 in this order. In FIG. 5, undercoating layer 4 is provided between conductive substrate 3 and charge generating layer 1. In FIG. 6, protective layer 5 is provided on the mirror surface of charge transporting layer 3. In FIG. 7, undercoating layer 4 is provided between conductive support 3 and charge generating layer 1, and protective layer 5 is provided on the surface of charge transporting layer 2.

The electrically conductive substrate which can be used in the present invention is conventional and includes a drum or sheet of a metal, e.g., aluminum, copper, iron, zinc, and nickel; and a drum, sheet or plate of paper, synthetic resins or glass, rendered electrically conductive by vacuum evaporation of a metal, e.g., aluminum, copper, gold, silver, platinum, palladium, titanium, nickel-chromium, stainless steel, and copper-indium, or vacuum evaporation of a conductive metal compound, e.g., indium oxide and tin oxide, by laminating metallic foil or by coating carbon black, indium oxide, a tin oxide-antimony oxide powder, a metallic powder, etc. dispersed in a binder resin.

If desired, an undercoating layer may be formed between the conductive substrate and a charge generating layer. The undercoating layer serves to block charge transfering from the substrate to the photosensitive layer having a laminated structure at the time of charging; to improve adhesion of the photosensitive layer to the substrate; and, in some cases, to prevent light reflection on the substrate.

Suitable resins which can be used in an undercoating layer include known resins, e.g., polyethylene, polypropylene, acrylic resins, methacrylic resins, polyamide resins, vinyl chloride resins, vinyl acetate resins, phenolic resins, polycarbonate, polyurethane, polyimide resins, vinylidene chloride resins, polyvinyl acetal resins, vinyl chloride-vinyl acetate copolymers, polyvinyl alcohol, water-soluble polyester, nitrocellulose, casein, and gelatin.

The undercoating layer usually has a thickness of from 0.01 to 10 μm, and preferably from 0.05 to 2 μm.

In the present invention, selenium or a selenium alloy and the squarylium compound of formula (I) are used as charge generating material to be incorporated into the photosensitive layer or charge generating layer. Selenium or selenium alloys which can be used include amorphous trigonal selenium, a selenium-tellurium alloy, a selenium-tellurium-arsenic alloy, and a mixture thereof. Particularly preferred of them is trigonal selenium.

The squarylium compound represented by formula (I) exhibits satisfactory dispersibility and satisfactory stability to coating solvents and does not induce sensitivity reduction when mixed with selenium or a selenium alloy.

Specific examples of the squarylium compound of formula (I) are shown below.

| Compound No. | A | B |
|---|---|---|
| (1) | —F | —OH |
| (2) | —H | —OH |
| (3) | —OH | —OH |
| (4) | —H | —$CH_3$ |
| (5) | —F | —$CH_3$ |

Amount these, Compound Nos. (1) and (3) are preferred.

A mixing ratio of selenium or a selenium alloy to the squarylium compound represented by formula (I) preferably ranges from 10/1 to 1/1, and more preferably from 9/1 to 7/3, by volume.

Where the photosensitive layer has a laminated structure, suitable binder resins which can be used in the charge generating layer include polystyrene resins, polyvinyl acetal resins, acrylic resins, methacrylic resins, vinyl chloride resins, vinyl acetate resins, polyester resins, polyarylate resins, polyurethane resins, epoxy resins, polycarbonate resins, phenolic resins, etc., and copolymer resins comprising at least two repeating units which constitute the above-enumerated resins, e.g., vinyl chloride-vinyl acetate copolymers and vinyl chloride-vinyl acetate-maleic anhydride copolymers, either individually or in combination of two or more thereof. Amont these, vinyl chloride-vinyl acetate-maleic anhydride copolymers are preferred.

An amount of a mixture of selenium or selenium alloy and the squarylium compound used is preferably from 10 to 90% by volume and more preferably from 50 to 70% by volume per the total volume of the mixture of selenium or selenium alloy and squarylium compound and the binder resin.

Selenium or a selenium alloy and the squarylium compound can be dispersed in the binder resin by any means, such as a ball mill, a sand mill, and an attritor. Selenium or a selenium alloy and the squarylium compound may be previously mixed together and then dispersed in the binder resin, or they may be separately dispersed in the binder resin and then mixed together. The charge generating materials (i.e., selenium or selenium alloy and squarylium compound) are preferably dispersed to a particle size of generally not more than 5 μm, more preferably not more than 2 μm, and most preferably not more than 0.5 μm.

Solvents which can be used for dispersion include commonly employed organic solvents, e.g., methanol, ethanol, n-propanol, n-butanol, benzyl alcohol, methyl cellosolve, ethyl cellosolve, acetone, methyl ethyl ketone, cyclohexanone, methyl acetate, dioxane, tetrahydrofuran, methylene chloride, and chloroform, either individually or in combination of two or more thereof.

The charge generating layer has a thickness usually of from 0.1 to 5 μm, preferably from 0.2 to 2.0 μm, and more preferably from 0.2 to 0.4 μm.

The charge generating layer can be formed by any known coating techniques, such as blade coating, wire bar coating, spray coating, dip coating, bead coating, and curtain coating.

On the other hand, a charge transporting layer is formed by incorporating a charge transporting material into an appropriate binder resin.

Suitable charge transporting material which can be used in the present invention include oxadiazole derivatives, e.g., 2,5-bis(p-diethylaminophenyl)-1,3,4-oxadiazole; pyrazoline derivatives, e.g., 1,3,5-triphenylpyrazoline and 1-[pyridyl-(2)]-3 -(p-diethylaminostyryl)-5 -(p-diethylaminophenyl)pyrazoline; aromatic tertiary amino compounds, e.g., triphenylamine and dibenzylaniline; aromatic tertiary diamino compounds, e.g., N,N'-diphenyl-N,N'-bis(3-methylphenyl)-[1,1-biphenyl]-4,4'-diamine; 1,2,4-triazine derivatives, e.g., 3-(4'-dimethylaminophenyl)-5,6-di(4'-methoxyphenyl)-1,2,4-triazine; hydrazone derivatives, e.g., 4-diethylaminobenzaldehyde-1,1-diphenylhyirazone; quinazoline derivatives, e.g., 2-phenyl-4-styrylquinazoline; benzofuran derivatives, e.g., 6-hydroxy-2,3-di(p-methoxyphenyl)benzofuran; α-stilbene derivatives, e.g., p-(2,2-diphenylvinyl)-N,N-diphenylaniline; enamine derivatives described in *Journal of Imaging Science*, Vol. 29, pp. 7–10 (1985); carbazole derivatives, e.g., N-ethylcarbazole; poly-N-vinylcarbazole and derivatives thereof; poly-γ-carbazolylethyl glutarate and derivatives thereof; and other known charge transporting materials, e.g., pyrene, polyvinylpyrene, polyvinylanthracene, polyvinylacridine, poly-9-biphenylanthracene, pyreneformaldehyde resins, and ethylcarbazole-formaldehyde resins. These charge transporting materials may be used either individually or in combination of two or more thereof. Among these,

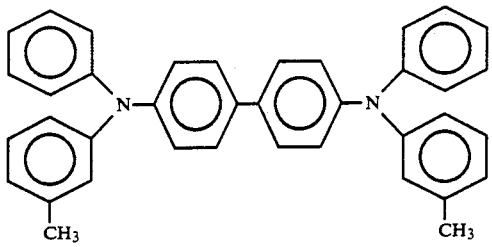

is preferred.

Suitable binder resins in which the charge transporting material is dispersed include polycarbonate resins, polyester resins, methacrylic resins, acrylic resins, vinyl chloride resins, vinylidene chloride resins, polystyrene resins, polyvinyl acetate resins, styrene-butadiene copolymer resins, vinylidene chloride-acrylonitrile copolymer resins, vinyl chloride-vinyl acetate copolymer resins, vinyl chloride-vinyl acetate-maleic anhydride copolymer resins, silicone resins, silicone-alkyd resins, phenol-formaldehyde resins, styrene alkyd resins, and poly-N-vinylcarbazole. These binder resins may be used either individually or in combination of two or more thereof.

An amount of the charge transporting material used is preferably from 15 to 90% by weight per the total weight of the charge transporting material and the binder resin.

The charge transporting layer generally has a thickness of from 5 to 50 μm, and preferably from 10 to 30 μm.

The charge transporting layer can be formed by any known coating technique, such as blade coating, wire bar coating, spray coating, dip coating, bead coating, and curtain coating.

Solvents which can be used for coating the charge transporting layer include generally employed organic solvents, such as aromatic hydrocarbons, e.g., benzene, toluene, xylene, and chlorobenzene; ketones, e.g., acetone and 2-butanone; halogenated aliphatic hydrocarbons, e.g., methylene chloride, chloroform, and ethylene chloride; and cyclic or straight chain ethers, e.g., tetrahydrofuran and ethyl ether; either individually or in combination of two or more thereof.

If desired, a protective layer may be provided on the charge transporting layer. The protective layer serves to prevent chemical deterioration of the charge transporting layer at the time of charging the photosensitive layer having a laminated structure and, at the same time, to improve mechanical strength of the photosensitive layer.

The protective layer can be formed by incorporating an electrically conductive material in an appropriate binder resin. Examples of suitable electrically conductive materials include metallocene compounds, e.g., N,N'-dimethylferrocene; aromatic amino compounds, e.g., N,N'-diphenyl-N,N'-bis(3-methylphenyl)-[1,1'-phenyl]-4,4'-diamine; and metal oxides, e.g., antimony oxide, tin oxide, titanium oxide, indium oxide, and tin oxide-antimony oxide.

Suitable binder resins for the protective layer include known resins, e.g., polyamide resins, polyurethane resins, polyester resins, epoxy resins, polyketone resins, polycarbonate resins, polyketone resins, polycarbonate resins, polyvinyl ketone resins, polystyrene resins, and polyacrylamide resins.

The protective layer is preferably constructed so as to have an electrical resistance of generally from $1\times10^9$ to $1\times10^{14}$ Ω.cm and preferably from $1\times10^9$ to $1\times10^{11}$ Ω.cm If an electrical resistance is higher than $1\times10^{14}$ Ω.cm, the residual potential increases only to provide reproduced images suffering from significant fog. If it is lower than $1\times10^9$ Ω.cm, the faint images are formed, or the resolving power is reduced.

Further, the protective layer should be so constructed not to substantially inhibit transmission of light to be used for imagewise exposure.

The protective layer has a thickness usually of from 0.5 to 20 μm, and preferably of from 1 to 10 μm.

The present invention is now illustrated in greater detail with reference to Examples, but it should be understood that the present invention is not to be limited thereto.

EXAMPLE 1

Trigonal selenium: 22 g
Modified polyvinyl butyral resin: 3 g
Butyl acetate: 50 g
Butanol: 15 g A mixture of the above components was put in a ball mill pot and ground for 60 hours by using stainless steel balls having a diameter of ⅛ inch as a grinding medium to prepare dispersion (A) for a charge generating layer.

Squarylium compound (Compound No. (1)): 7 g
Modified polyvinyl butyral resin: 3 g
Butanol: 90 g A mixture of the above components was put in a ball mill pot and ground for 20 hours by using glass beads having a diameter of 1 mm as a grinding medium to prepare dispersion (B) for a charge generating layer.

Fifty grams of dispersion (A) and 15 g of dispersion (B) were mixed using a sand mill and a paint shaker, and 20 g of butyl acetate was added to the mixture, followed by stirring to prepare a coating composition for a charge generating layer.

The resulting coating composition was dip-coated on an aluminum substrate to form a charge generating layer having a dry thickness of 0.25 μm.

A coating composition for a charge transporting layer was prepared from the following component.

α-Stilbene compound of formula: 8 g

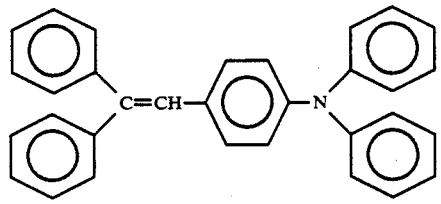

Polycarbonate resin: 12 g
Monochlorobenzene: 80 g

The coating composition was dip-coated on the charge generating layer to form a charge transporting layer having a dry thickness of 25 μm to obtain an electrophotographic photoreceptor comprising an electrically conductive substrate, a charge generating layer, and a charge transporting layer.

The following measurements were made on the resulting electrophotographic photoreceptor by means of an electrostatic paper analyzer ("EPA-8100" manufactured by Kawaguchi Denki K.K.) under a normal temperature and normal humidity condition (25° C., 40% RH).

1) $V_0$: surface potential immediately after negative charging to −6.0 kV by a corona discharge 2) $V_{1.0}$: surface potential after 1 second from the negative charging 3) DV/DE: decay rate of surface potential with monochromatic light of 550 nm or 800 nm isolated by a band pass filter 4) RP: surface potential after exposure to white light of 50 erg/cm$^2$ for 0.5 second The measurements were conducted on the first and 1000th cycles. The results obtained are shown in Table 1 below.

TABLE 1

| | 1st Cycle | 1000th Cycle |
|---|---|---|
| $V_0$ (V) | −859 | −852 |
| Dark Decay Rate $\lvert V_0-V_{1.0}\rvert$ (V) | 62 | 65 |
| DV/DE (550 nm) (V cm$^2$/erg) | 253 | 252 |
| DV/DE (800 nm) (V cm$^2$/erg) | 131 | 132 |
| RP (V) | −16 | −21 |

The same measurements were conducted under a high temperature and high humidity condition (30° C., 80% RH) or a low temperature and low humidity condition (10° C., 20% RH). The results obtained are shown in Table 2 below.

TABLE 2

| | 30° C., 80% RH | | 10° C., 20R RH | |
|---|---|---|---|---|
| | 1st Cycle | 1000th Cycle | 1st Cycle | 1000th Cycle |
| $V_0$ (V) | −848 | −845 | −841 | −838 |
| Dark Decay Rate $\lvert V_0-V_{1.0}\rvert$ | 63 | 67 | 56 | 59 |
| DV/DE (550 nm) (V cm$^2$/erg) | 256 | 255 | 245 | 243 |
| DV/DE (800 nm) (V cm$^2$/erg) | 135 | 134 | 121 | 118 |
| RP (V) | −14 | −15 | −35 | −42 |

and particularly stability to environment and/or repeated use.

COMPARATIVE EXAMPLE 1

An electrophotographic photoreceptor was prepared in the same manner as in Example 1, except that the charge generating layer was formed to a thickness of 0.1 μm by using only dispersion (B), with the content of the squarylium compound in the charge generating layer being the same. The electrostatic characteristics of the resulting photoreceptor were determined in the same manner as in Example 1. The results obtained are shown in Table 3 below.

TABLE 3

| | 25° C., 40% RH | | 30° C., 80% RH | | 10° C., 20% RH | |
|---|---|---|---|---|---|---|
| | 1st Cycle | 1000th Cycle | 1st Cycle | 1000th Cycle | 1st Cycle | 1000th Cycle |
| $V_0$ (V) | −763 | −714 | −697 | −532 | −725 | −804 |
| Dark Decay Rate $\lvert V_0-V_{1.0}\rvert$ (V) | 125 | 134 | 142 | 155 | 131 | 123 |
| DV/DE (800 nm) (V cm$^2$/erg) | 134 | 132 | 130 | 131 | 109 | 111 |
| RF (V) | −63 | −72 | −41 | −48 | −90 | −118 |

As is apparent seen from the results in Table 3, the electrophotographic photoreceptor containing the squarylium compound alone as a charge generating material has low electrification properties, a high dark decay rate, and poor stability to environment and/or repeated use. As compared with the results of Example 1, these disadvantages can be obviously improved by using a trigonal selenium-squarylium compound mixed system.

COMPARATIVE EXAMPLE 2

An electrophotographic photoreceptor was prepared in the same manner as in Example 1, except for replacing squarylium compound No. (1) with a comparative squarylium compound shown below. The electrostatic characteristics of the resulting photoreceptor were measured in the same manner as in Example 1, and the results obtained are shown below.

Squarylium Compound:

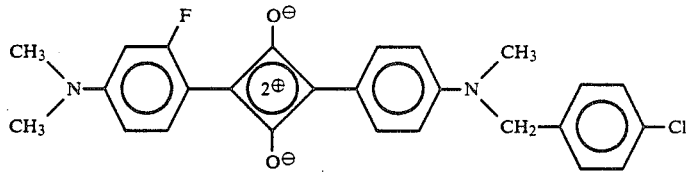

Figure 1:
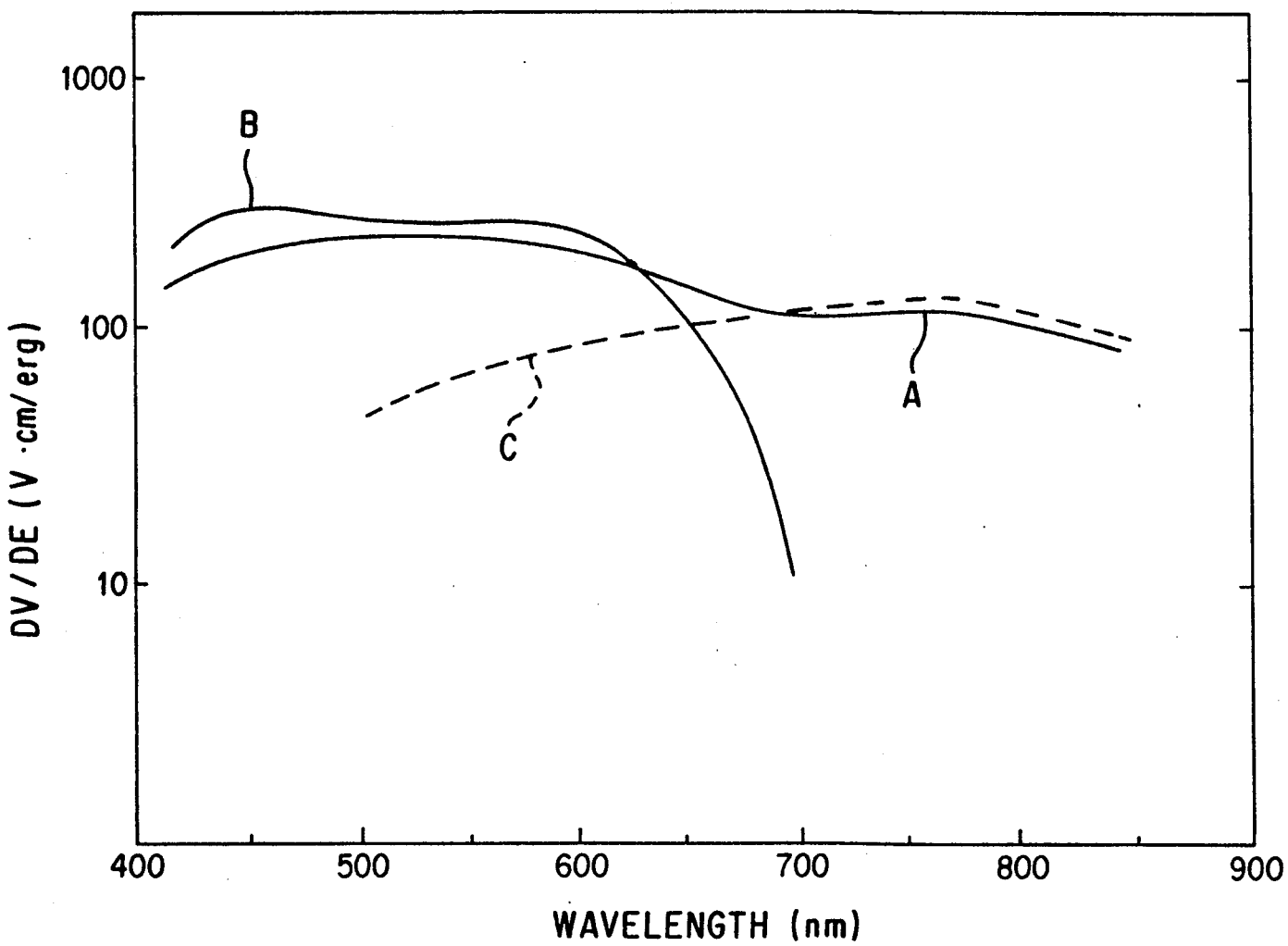
FIG. 1 is a spectral sensitivity curve of the electrophotographic photoreceptor according to Example 1 of the present invention.
Figure 2:
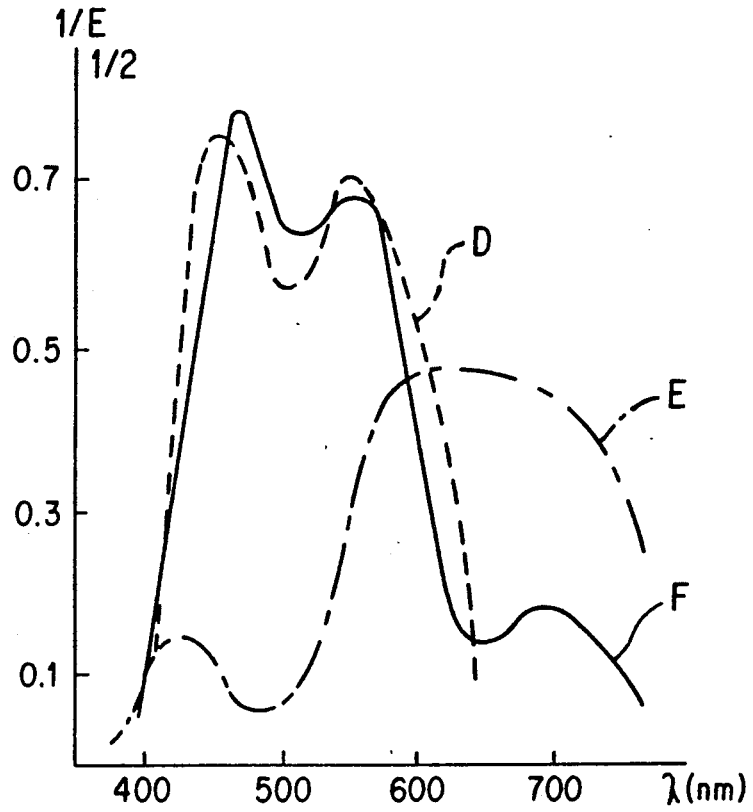
FIGS. 2 and 3 each is a spectral sensitivity curve of a conventional electrophotographic photoreceptor.
Figure 3:
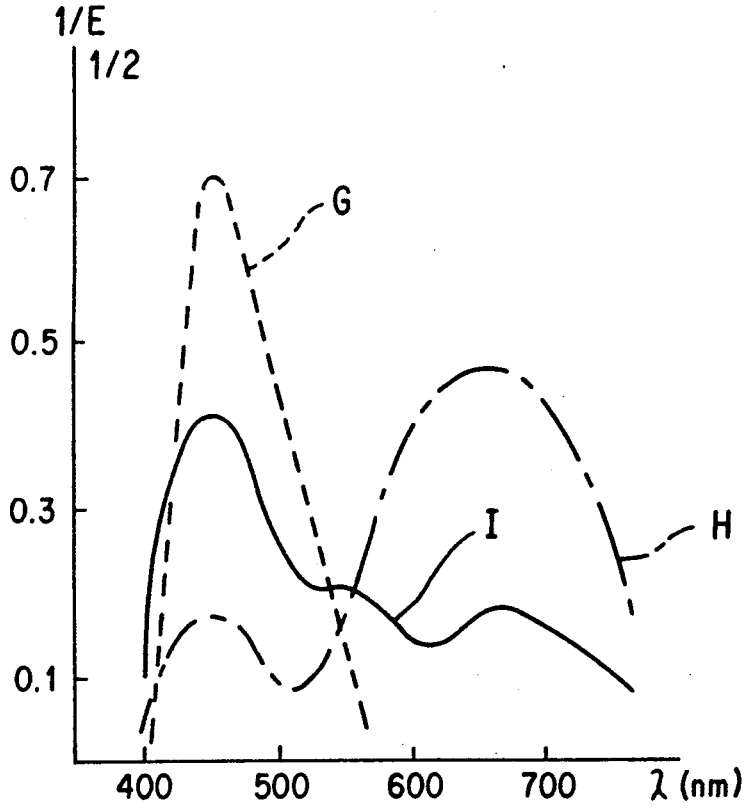

FIG. 1 shows spectral sensitivity characteristics of the electrophotographic photoreceptor in a wavelength region of from 400 nm to 850 nm. In FIG. 1, A, B, and C indicate spectral sensitivity of the electrophotographic photoreceptor, selenium, and squarylium compound No. (1), respectively.

As is apparent from the results shown above, the electrophotographic photoreceptor of the present invention has broad spectral sensitivity in the visible to infrared region, the sensitivity being not substantially inferior to that possessed by each of selenium and the squarylium compound, and the photoreceptor is also excellent in other electrophotographic characteristics, $V_0$: −842 V
Dark Decay Rate: 53 V
$\lvert V_0-V_{1.0}\rvert$
DV/DE (550 nm): 191 V cm$^2$/erg
DV/DE (800 nm): 96 V cm$^2$/erg
RP: −23 V It is clearly seen from the above results that use of a squarylium compound other than those of the present invention causes reduction in sensitivity in the visible region.

EXAMPLE 2

Trigonal selenium: 22 g

Squarylium compound No. (2): 3 g
Modified polyvinyl butyral resin: 5 g
Butyl acetate: 50 g
Butanol: 20 g A mixture of the above components was put in an attritor pot and ground for 30 hours by using stainless steel balls having a diameter of ⅛ inch as a grinding medium. The dispersion was diluted with 100 g of butyl acetate, followed by stirring to prepare a composition for a charge generating layer. The composition was dip-coated on an aluminum substrate to form a charge generating layer having a dry thickness of 0.35 μm.

A coating composition having the following formulation was dip-coated on the thus formed charge generating layer to form a charge transporting layer having a dry thickness of 25 μm to obtain an electrophotographic photoreceptor comprising an electrically conductive substrate, a charge generating layer, and a charge transporting layer.

4-Diethylaminobenzaldehyde-1,1'- 8 g diphenylhydrazone:
Polycarbonate resin: 12 g
Methylene chloride: 80 g Electrostatic characteristics of the resulting photoreceptor were measured in the same manner as in Example 1. The results obtained were as follows.

$V_0$: −851 V
Dark Decay Rate: 53 V
$|V_0-V_{1.0}|$
DV/DE (550 nm): 253 V $cm^2$/erg
DV/DE (800 nm): 128 V $cm^2$/erg
RP: −21 V As is apparent from these results, the photoreceptor of this example not only has broad spectral sensitivity of from visible to infrared region but is excellent in other electrophotographic characteristics similarly to the photoreceptor of Example 1.

EXAMPLE 3

A coating composition having the following formulation was dip-coated on an aluminum substrate to form an undercoating layer having a dry thickness of 0.5 μm.

Modified polyvinyl butyral resin: 5 g
Methanol: 75 g
Methylene chloride: 20 g

Then, a coating composition for a charge generating layer was prepared as follows.

Trigonal selenium: 20
Squarylium compound No. (3): 7 g
Vinyl chloride-vinyl acetate-maleic: 3 g
Butyl acetate: 90 g The above components were put in an attritor pot and ground for 30 hours by using stainless steel balls having a diameter of ⅛ inch as a grinding medium. The dispersion was diluted with 100 g of butyl acetate, followed by stirring.

The resulting coating composition for a charge generating layer was dip-coated on the undercoating layer to form a charge generating layer having a dry thickness of 0.35 μm.

A coating composition having the following formulation was then coated on the charge generating layer to form a charge transporting layer having a dry thickness of 25 μm to obtain an electrophotographic photoreceptor comprising an electrically conductive substrate, an undercoating layer, a charge generating layer, and a charge transporting layer.

Benzidine compound of formula: 8 g

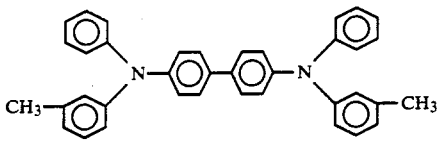

Polycarbonate resin: 12 g
Methylene chloride: 80 g

Electrostatic characteristics of the resulting photoreceptor were measured in the same manner as in Example 1, and the results obtained are shown below.

$V_0$: −845 V
Dark Decay Rate: 49 V
$|V_0-V_{1.0}|$
DV/DE (550 nm): 248 V $cm^2$/erg
DV/DE (800 nm): 116 V $cm^2$/erg
RP: −31 V As is apparent from these results, the photoreceptor of this example not only has broad spectral sensitivity of form visible to infrared region but is excellent in other electrophotographic characteristics.

EXAMPLE 4

An electrophotographic photoreceptor was prepared in the same manner as in Example 2, except for replacing squarylium compound No. (2) with squarylium compound No. (4).

Electrostatic characteristics of the resulting photoreceptor were determined in the same manner as in Example 1. The results obtained are shown below.

$V_0$: −824 V
Dark Decay Rate: 61 V
$|V_0-V_{1.0}|$
DV/DE (550 nm): 247 V $cm^2$/erg
DV/DE (800 nm): 92 V $cm^2$/erg
RP: −45

As is apparent from these results, the photoreceptor of this example not only has broad spectral sensitivity of from visible to infrared region but is excellent in other electrophotographic characteristics.

EXAMPLE 5

An electrophotographic photoreceptor was prepared in the same manner as in Example 3, except for replacing squarylium compound No. (3) with squarylium compound No. (5).

Electrostatic characteristics of the resulting photoreceptor were determined in the same manner as in Example 1. The results obtained are shown below.

$V_0$: −835 V
Dark Decay Rate: 63 V
$|V_0-V_{1.0}|$
DV/DE (550 nm): 251 V $cm^2$/erg
DV/DE (800 nm): 94 V $cm^2$/erg
RP: −43

As is apparent from these results, the photoreceptor of this example not only has broad spectral sensitivity of from visible to infrared region but is excellent in other electrophotographic characteristics.

EXAMPLE 6

A drum type electrophotographic photoreceptor was prepared under the same conditions as in Example 1. The photoreceptor was fixed to an electrophotographic copying machine ("FX-2700", modified model manufactured by Fuji Xerox; exposure wavelength: visible region), and a reproduced image was formed. There was obtained a clear image with high contrast and high fidelity. When copying was carried out 10,000 times, the image quality of the 10,000th copy was equal to the first copy.

The same electrophotographic photoreceptor was fixed to a semiconductor laser printer ("FX EX-11" manufactured by Fuji Xerox; exposure wavelength: infrared region). There was similarly obtained a clear image with high contrast and high fidelity.

As is clearly demonstrated by the foregoing Examples and Comparative Examples, the electrophotographic photoreceptors according to the present invention, in which selenium or a selenium alloy and the specific squarylium compound are used as charge generating materials, have broad spectral sensitivity from the visible to infrared region, with the sensitivity being not substantially inferior to each of only the selenium component or only the squarylium compound, and also exhibit excellent other electrophotographic characteristics, particularly stability to environment and/or repeated use.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising an electrically conductive substrate having thereon a photosensitive layer, wherein the photosensitive layer contains, as a charge generating material, a dispersion of selenium or a selenium alloy and at least one squarylium compound represented by formula (I):

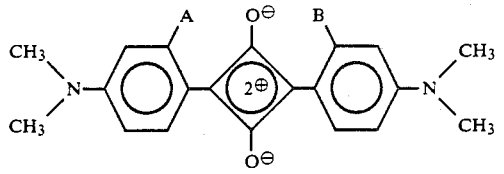

(I)

wherein A represents a fluorine atom, a hydrogen atom or a hydroxyl group, with B representing a hydroxyl group; or A represents a hydrogen atom or a fluorine atom, with B representing a methyl group, in the same binder resin.

2. The electrophotographic photoreceptor as claimed in claim 1, wherein selenium is trigonal selenium.

3. The electrophotographic photoreceptor as claimed in claim 1, wherein the photosensitive layer is composed of a charge generating layer and a charge transporting layer.

4. The electrophotographic photoreceptor as claimed in claim 1, wherein a mixing ratio of said selenium or selenium alloy to said squarylium compound represented by formula (I) is from 10/1 to 1/1.

5. The electrophotographic photoreceptor as claimed in claim 1, wherein an amount of a mixture of said selenium or selenium alloy and said squarylium compound used is from 10 to 90% by volume per the total volume of the mixture of selenium or selenium alloy and squarylium compound and the binder resin.

6. The electrophotographic photoreceptor as claimed in claim 1, wherein said selenium or selenium alloy and said squarylium compound have a particle size of not more than 5 μm.

* * * * *